US007048549B1

(12) United States Patent
Swain

(10) Patent No.: US 7,048,549 B1
(45) Date of Patent: May 23, 2006

(54) DUAL COMPRESSION CONTACT AND INTERPOSER CONNECTOR COMPRISING SAME

(75) Inventor: Wilfred James Swain, Mechanicsburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/072,167

(22) Filed: Mar. 4, 2005

(51) Int. Cl.
*H01R 12/00* (2006.01)

(52) U.S. Cl. ..... 439/66; 439/591

(58) Field of Classification Search ..... 439/66, 439/71, 68, 342, 525, 591
See application file for complete search history.

(56) References Cited

U.S. PATENT DOCUMENTS

| | | | | |
|---|---|---|---|---|
| 5,139,427 | A | 8/1992 | Boyd et al. | 439/66 |
| 5,308,252 | A * | 5/1994 | Mroczkowski et al. | 439/66 |
| 5,324,205 | A | 6/1994 | Ahmad et al. | 439/66 |
| 5,380,210 | A | 1/1995 | Grabbe et al. | 439/66 |
| 6,695,624 | B1 | 2/2004 | Szu | 439/66 |
| 6,784,372 | B1 | 8/2004 | Yuen et al. | 174/250 |
| 6,866,520 | B1 * | 3/2005 | Chiang | 439/66 |
| 6,872,082 | B1 * | 3/2005 | Hsu et al. | 439/66 |
| 6,881,070 | B1 * | 4/2005 | Chiang | 439/66 |
| 6,893,269 | B1 * | 5/2005 | Matsunaga | 439/66 |
| 6,913,469 | B1 * | 7/2005 | Chiang | 439/66 |
| 2003/0003784 | A1 | 1/2003 | Neidich | 439/82 |
| 2004/0253844 | A1 * | 12/2004 | Mendenhall et al. | 439/66 |
| 2004/0259394 | A1 * | 12/2004 | Chiang | 439/66 |

* cited by examiner

*Primary Examiner*—Hien Vu
(74) *Attorney, Agent, or Firm*—Woodcock Washburn LLP

(57) ABSTRACT

A dual compression electrical contact including a contact body having a first contact wall and a second contact wall, a first elastically bendable beam extending from the first contact wall, and a second elastically bendable beam extending form the second contact wall and from a position that is diagonally opposite to that from which the first elastically bendable beam extends.

23 Claims, 3 Drawing Sheets

DUAL COMPRESSION CONTACT AND INTERPOSER CONNECTOR COMPRISING SAME

FIELD OF THE INVENTION

The present invention relates to dual compression electrical contacts and interposer connectors containing the same.

BACKGROUND OF THE INVENTION

Interposer connectors or sockets typically include a dielectric plate with an array of through-holes formed therein, with electrical contacts disposed in each of the through-holes. The interposer connectors form electrical connections between overlying and underlying electrical devices, including, for example, central processing units, printed circuit boards and other structures, integrated circuit packages, and multi-chip substrates. These electrical devices employ multiple contact pads arranged in a very close proximity to each other, such as, for example, one millimeter centerline-to-centerline spacing. Electrical contacts employed in the interposer connectors generally include one or more elastically bendable beams that mechanically engage the contact pads. When the interposer connector is sandwiched between overlying and underlying devices, the elastically bendable beams engage respective contact pads to form an electrical connection between the two devices.

SUMMARY OF THE INVENTION

The present invention is generally directed to an LGA-LGA connector that has increased density and ease of manufacture. The connector has one or more novel contacts that each define a reversed mirror image, taken along a contact body of each contact. In accordance with one preferred embodiment of the present invention, there has now been provided a dual compression electrical contact having a contact body including a first contact wall and a second contact wall that is oriented substantially perpendicular to the first contact wall. Elastically bendable beams extend from the contact body from positions that are both longitudinally and laterally offset from one another.

In accordance with another preferred embodiment of the present invention, there has now been provided a dual compression contact having a contact body, and first and second cantilevered beams extending from the contact body. The second cantilevered beam extends in a direction that is substantially perpendicular to the extension direction of the first cantilevered beam. Each of the first and second cantilevered beams includes a contact region. The cantilevered beams are arranged so that the first and second contact regions are in-line with one another.

In accordance with yet another preferred embodiment of the present invention, there has now been provided a dual compression contact having a contact body that includes a first contact wall and a second contact wall. A first elastically bendable beam extends from the first contact wall. And a second elastically bendable beam extends from the second contact wall and from a contact body location that is diagonally opposite to that from which the first beam extends.

These and various other features of novelty, and their respective advantages, are pointed out with particularity in the claims annexed hereto and forming a part hereof. However, for a better understanding of aspects of the invention, reference should be made to the drawings which form a further part hereof, and to the accompanying descriptive matter, in which there is illustrated preferred embodiments.

DETAILED DESCRIPTION OF ILLUSTRATIVE EMBODIMENTS

Figure 1:
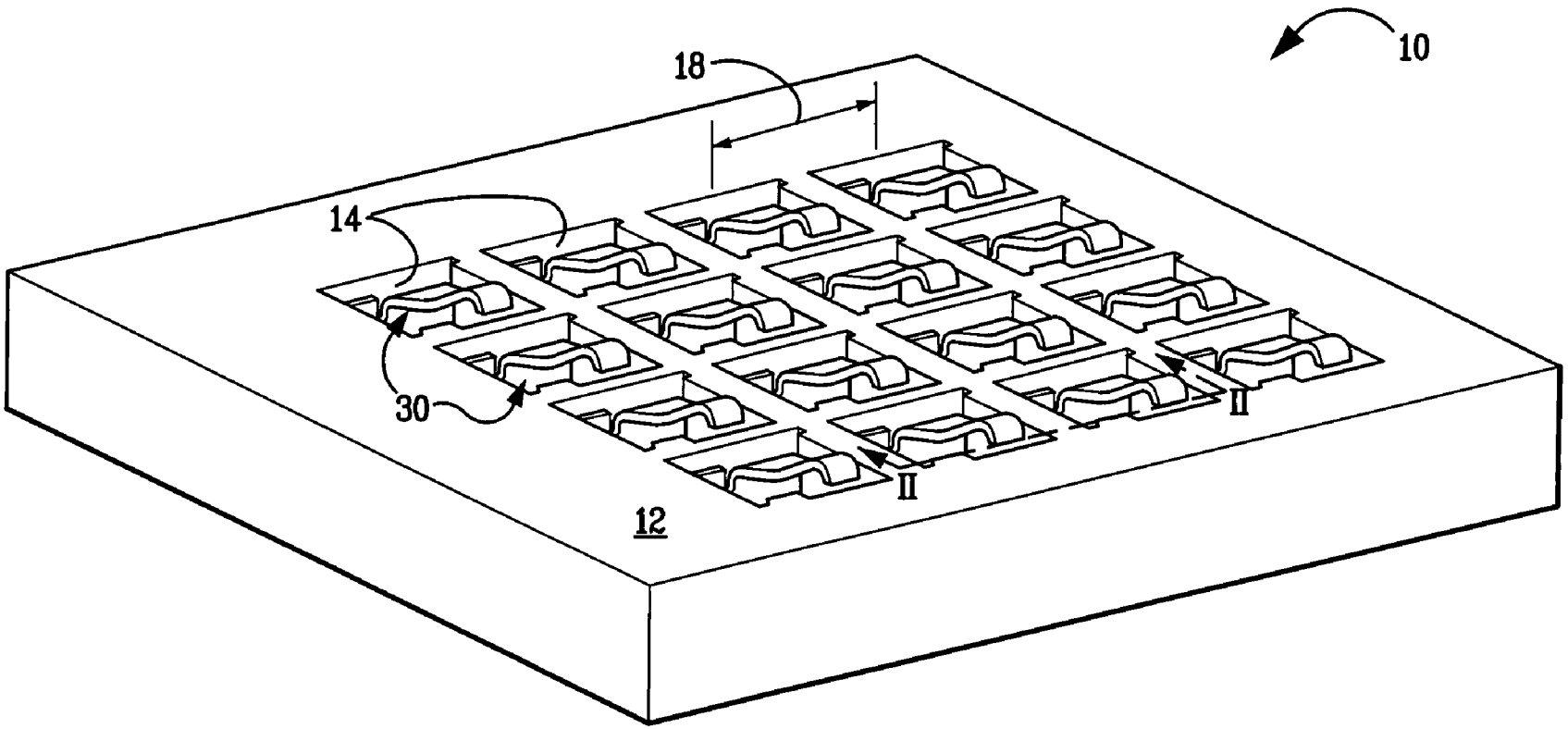
FIG. 1 is a perspective view of a preferred interposer connector embodiment provided by the present invention.
Figure 2:
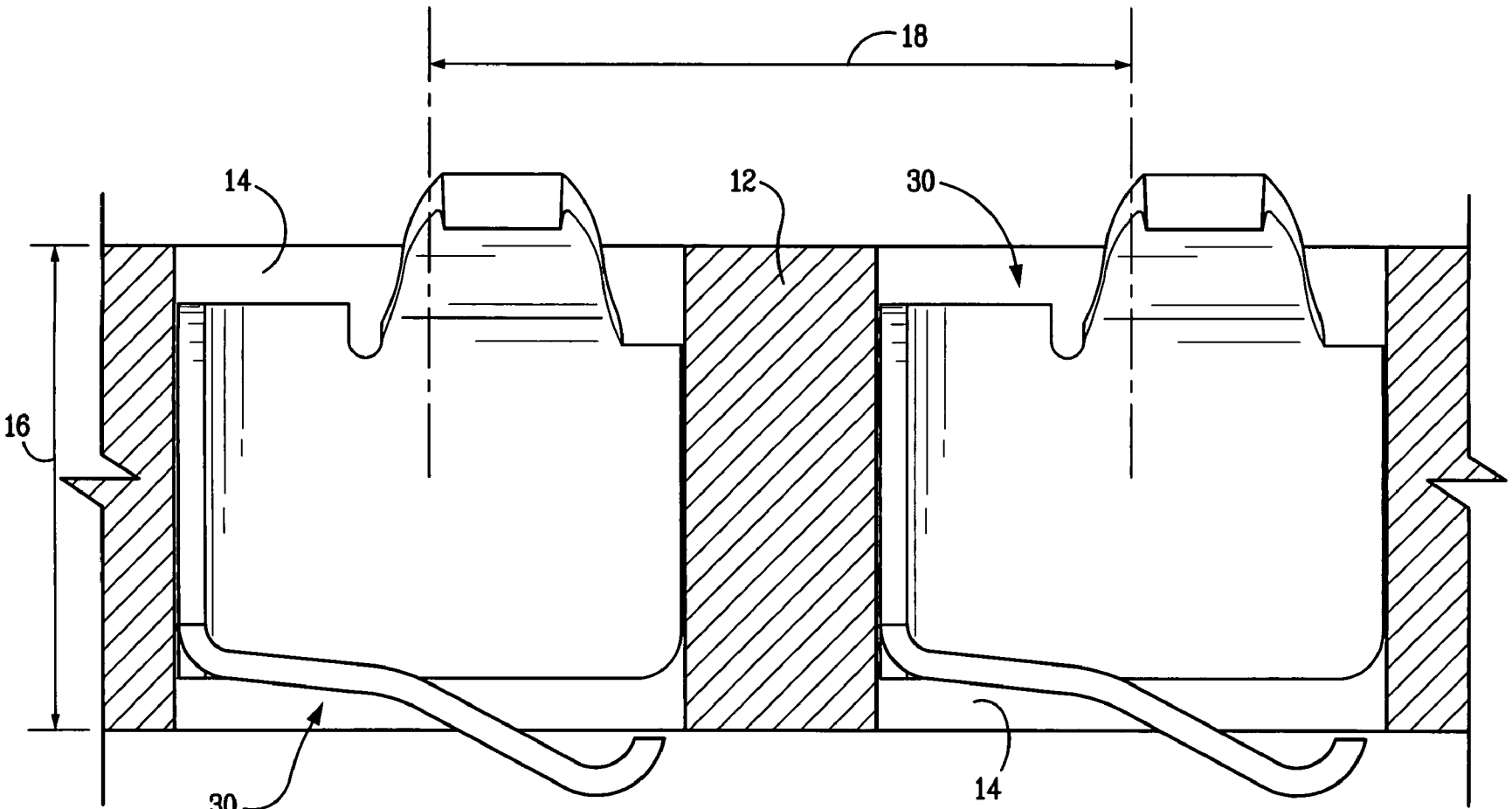
FIG. 2 is a cross-sectional view of the connector shown in FIG. 1 taken through line II—II.

Referring now to FIGS. 1 and 2, an exemplary interposer connector 10 is shown including a substrate 12 having a plurality of through-holes 14 formed therein, and an exemplary electrical contact 30 disposed in each of the through-holes. Substrate 12 is preferably made with dielectric materials that are known by one of ordinary skill in the art, including, but not limited to, glass-filled nylon, LCP, low moisture-absorbing nylon, PBT, PET, polycarbonate and polysulfones. Substrate 12 may also be made with thermally conductive materials, and preferably, thermally conductive thermoplastics. Suitable thermally conductive thermoplastics are currently available from PolyOne Corp., Cool Polymers, LNP Engineering Plastics, TRP Co., and Ticona Corp. Although most thermoplastics, particularly those traditionally used in the electronics industry, are good insulators, fillers or additives can be compounded with existing base polymers (e.g., nylons, liquid crystal polymers, and polyesters) to impart thermal conductivity. Among the most commonly used heat-conductive additives are graphite carbon fibers; carbon power; metallic fillers such as copper powder, steel, aluminum power, and aluminum flake; and ceramic fillers such as aluminum nitride and boron nitride. Thermally conductive polymers can be produced in either electrically or non-electrically conductive grades, either of which may be used in a connector application of the present invention.

It is generally desirable, although not required, to minimize both the thickness of substrate 12 and the centerline-to-centerline spacing between contacts 30. In one preferred embodiment, substrate 12 has a thickness 16 of 0.7 mm or less. Substrates of a greater thickness are also contemplated by the present invention. A preferred centerline-to-centerline contact spacing 18 is 1 mm or less. Spacing greater than 1 mm can equally be employed in accordance with the present invention.

The interposer connector 10 shown in FIGS. 1 and 2 includes a contact 30 in all of the plurality of through-holes 14. In alternative embodiments, some of the through-holes do not contain an electrical contact. This vacancy may provide a heat dissipation pathway to facilitate heat transfer away from the interposer connector or the electronic devices engaged with the connector. As can also be seen in FIGS. 1 and 2, all of contacts 30 are similarly configured. Other interposer connectors of the present invention employ contacts having dissimilar configurations with respect to each other, including for example, electrical contacts having different engagement features and geometries. All of contacts 30 are shown in FIGS. 1 and 2 as being arranged in the same direction with respect to the dielectric housing. Other contact directional orientations are also contemplated by the present invention, including, but not limited to, random contact orientation and various patterns, such as, for example, alternating rows, squares, and diagonals.

Figure 3:
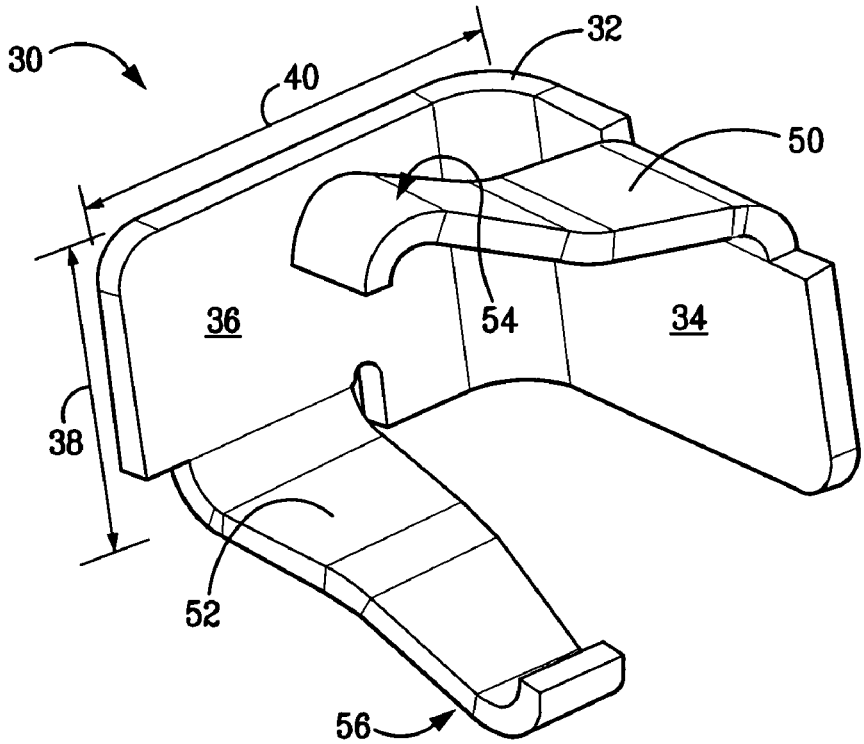
FIG. 3 is a perspective view of one preferred dual compression contact according to the present invention.
Figure 4:
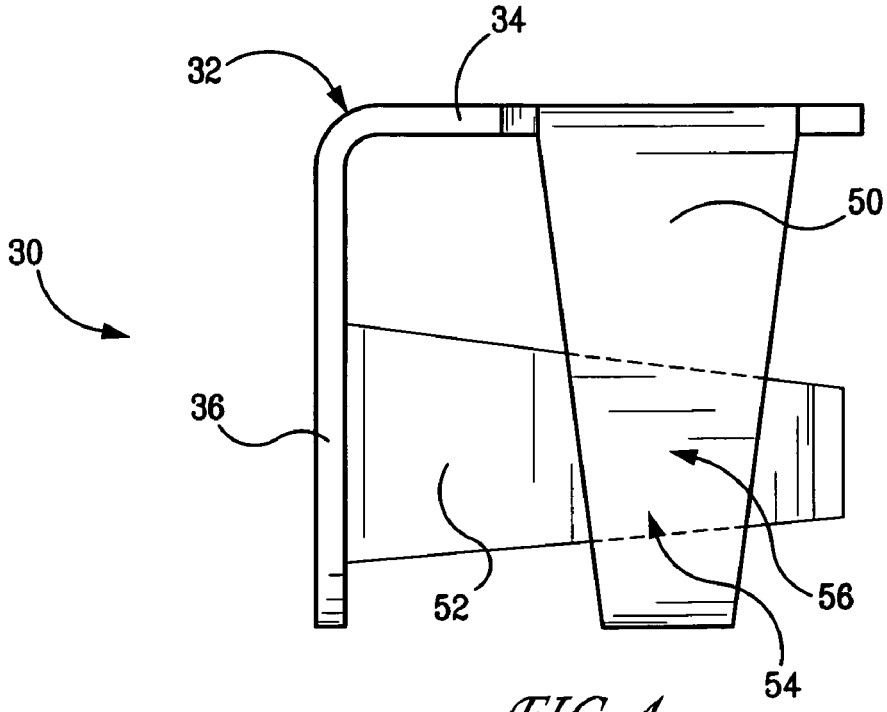
FIG. 4 is a plan view of the contact shown in FIG. 3.

Exemplary contact 30 is shown and described in greater detail with reference to FIGS. 3 and 4. Contact 30 includes a contact body 32 comprising contact walls 34 and 36. Contact wall 34 is preferably arranged, as can be seen in the figures, perpendicular (orthogonal) to contact wall 36. Other orientations are within the spirit of the invention. In one preferred embodiment, each of contact walls 34 and 36 have a height 38 of about 0.7 mm and a length 40 of about 0.8 mm. Contact walls of a different height and length are included in the present invention. In preferred embodiments, contact walls 34 and 36 are symmetrically configured, meaning that the contact walls have equal heights 38, lengths 40, and/or overall geometries. The contact walls may also be configured differently.

Cantilevered beams 50 and 52 extend from contact walls 34 and 36, respectively. Cantilevered beams 50, 52 are elastically bendable or deformable. The meaning of "elastically bendable," as that term is used herein, is intended to be broadly construed, and to at least include all of the meaningful definitions found within lay person and scientific dictionaries. Elastically bendable/deformable generally means that beams 50 and 52 can be bent, deformed, or otherwise deflected upon engagement with an electronic device (or other applied forces) and then return substantially to their non-engaged position after the electronic device is removed from the interposer connector. It should be understood that some permanent or plastic deformation may occur after beams 50 and 52 have been engaged one or more times. That is, beams 50 and 52 may not completely return to their original non-engaged position.

As can be seen in the figures, beams 50 and 52 extend from opposing edges of contact body 32, whereby the beams extend from contact body positions that are both longitudinally and laterally offset from each other. In a preferred embodiment, beam 50 extends in a direction that is perpendicular to an extension direction of beam 52, and extends from contact body 32 position that is diagonally opposite to that from which beam 52 extends. As the foregoing configurations are only preferred, other orientations and extension positions may be used without departing from the spirit of the present invention.

Each of cantilevered beams 50 and 52 are slightly tapered and has a distal portion that includes an arcuate-shaped contact region 54 and 56, respectively. In preferred embodiments, and as shown in the figures, contact region 54 is substantially in-line with contact region 56 (as best seen in FIGS. 2 and 4). The design features described in this paragraph are optional, and may be altered or eliminated altogether.

Referring again to FIGS. 1 and 2, the distal portions of cantilevered beams 50 and 52 extend beyond respective major surfaces of substrate 12, so that engagement features associated with electronic devices, such as LGA (Land Grid Array) pads, can engage, wipe, and electrically connect to contact regions 54, 56. Upon mating electronic devices with interposer connector 10, the electronic devices compress or elastically bend the cantilevered beams typically to the point where the distal portions of the cantilevered beams no longer extend beyond the major surfaces of substrate 12. When the electronic devices are removed, potential energy will drive the cantilevered beams substantially back to their non-engaged position.

The electrical contacts of the present invention are preferably made from copper alloys, and other materials known by one of ordinary skill in the art. At least some portions, for example, the contact regions, may also contain plating material—e.g., gold and/or nickel. In preferred embodiments, the contacts have a thickness ranging from about 0.03 mm to about 0.10 mm (contacts having a different thickness are also contemplated). The contacts may be stamped from a single sheet of material and then formed into its finished configuration. Alternate manufacturing techniques can equally be employed.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

The invention claimed is:

1. A dual compression electrical contact, comprising:

a substantially L-shaped contact body including a first contact wall and a second contact wall that is oriented substantially perpendicular to the first contact wall;

a first elastically bendable beam extending from the first contact wall from a first position; and a second elastically bendable beam extending from the second contact wall from a second position, the second elastically bendable beam being oriented substantially perpendicular to the first elastically bendable beam;

wherein the first position is both longitudinally and laterally offset from the second position.

2. The contact of claim 1, wherein the first contact wall and the second contact wall are the same height.

3. The contact of claim 1, wherein the first elastically bendable beam includes a first contact region and the second elastically bendable beam includes a second contact region, and wherein the first and second contact regions are in-line with one another.

4. The contact of claim 1, wherein the first and second contact walls are substantially symmetrically configured with respect to each other.

5. A dual compression electrical contact, comprising:

a contact body including a first contact wall and a second contact wall;

a first cantilevered beam comprising a curved portion adjoining the first contact wall, and a second portion adjoining the curved portion and including a first contact region; and a second cantilevered beam comprising a curved portion adjoining the second contact wall at a location diagonally opposite the location on the first contact wall at which the curved portion of the first cantilevered beam adjoins the first contact wall, and a second portion adjoining the curved portion of the second cantilevered beam and extending in a direction that is substantially perpendicular to that of the second portion of the first cantilevered beam, the second portion of the second cantilevered beam including a second contact region that is in-line with the first contact region.

6. The contact of claim 5, wherein the second contact wall is oriented substantially perpendicular to the first contact wall.

7. The contact of claim 5, wherein the first contact wall and the second contact wall are the same height.

8. The contact of claim 5, wherein the first and second contact walls are substantially symmetrically configured with respect to each other.

9. A dual compression electrical contact, comprising:

a substantially L-shaped contact body including a first contact wall and a second contact wall that intersects the first contact wall;

a first elastically bendable beam extending transversely from the first contact wall in a first direction; and a second elastically bendable beam extending transversely from the second contact wall in a second direction transverse to the first direction, wherein the first contact wall and the first elastically bendable beam form a reversed mirror image of the second contact wall and the second elastically bendable beam about the intersection of the first contact wall and the second contact wall.

10. The contact of claim 9, wherein the first contact wall is oriented substantially perpendicular to the second contact wall.

11. The contact of claim 9, wherein the second elastically bendable beam extends in a direction that is substantially perpendicular to that of the first elastically bendable beam.

12. The contact of claim 9, wherein the first elastically bendable beam includes a first contact region and the second elastically bendable beam includes a second contact region, and wherein the first and second contact regions are in-line with one another.

13. The contact of claim 9, wherein the first and second contact walls are substantially symmetrically configured with respect to each other.

14. An interposer connector, comprising:

a substrate including a plurality of spaced apart through-holes;

a dual compression contact in accordance with claim 1 disposed in at least some of the plurality of spaced apart through-holes.

15. The connector of claim 14, wherein the dielectric substrate has a thickness of about 0.7 mm or less.

16. The connector of claim 14, wherein contact center-line-to-centerline spacing is 1 mm or less.

17. The connector of claim 14, wherein for each of the contacts and through-holes, each of the first and second contact walls abut up against a wall of the through-hole.

18. An interposer connector, comprising:

a substrate including a plurality of spaced apart through-holes;

a dual compression contact in accordance with claim 5 disposed in at least some of the plurality of spaced apart through-holes.

19. An interposer connector, comprising:

a substrate including a plurality of spaced apart through-holes;

a dual compression contact in accordance with claim 9 disposed in at least some of the plurality of spaced apart through-holes.

20. A dual compression electrical contact, comprising:

a substantially L-shaped contact body including an upper edge and a lower edge, the upper edge having a first portion and a second portion, the first portion having a first height and the second portion having a second height different than the first height, the lower edge having a first portion and a second portion, the first portion of the lower edge having a third height and the second portion of the lower edge having a fourth height different than the third height;

a first elastically bendable beam having a curved portion adjoining the first portion of the upper edge, the first elastically bendable beam extending transversely from the upper edge in a first direction; and a second elastically bendable beam having a curved portion adjoining the first portion of the lower edge, the second elastically bendable beam extending transversely from the lower edge in a second direction transverse to the first direction.

21. The connector of claim 20 wherein:

the first elastically bendable beam further comprises a second portion having a first end adjoining the curved portion of the first elastically bendable beam, and a second freestanding end; and the second elastically bendable beam further comprises a second portion having a first end adjoining the curved portion of the second elastically bendable beam, and a freestanding second end.

22. An interposer connector for electrically connecting a first and a second electronic device, comprising:

a substrate having a first and a second major surface, and a plurality of spaced apart through-holes extending between the first and second major surfaces; and a plurality of dual compression contacts in accordance with claim 21 disposed in at least some of the plurality of spaced apart through-holes, wherein:

the freestanding ends of the first and second elastically bendable beams extend beyond the respective first and second major surfaces when the connector is in an unmated condition, and the first and second elastically bendable beams can flex so that the freestanding ends of the first and second elastically bendable beams do not extend beyond the respective first and second major surfaces when the connector is mated with the first and second electronic devices.

23. The connector of claim 22, wherein the curved portion of the first elastically bendable beam has a height approximately equal to the vertical offset between the first and second portions of the upper surface, and the curved portion of the second elastically bendable beam has a height approximately equal to the vertical offset between the first and second portions of the lower surface.

* * * * *